US005142257A

United States Patent [19]

Gamet

[11] Patent Number: 5,142,257

[45] Date of Patent: Aug. 25, 1992

[54] DEVICE FOR THE AUTOMATIC RECLOSING OF BREAKERS AND BREAKERS EQUIPPED WITH SUCH A DEVICE

[76] Inventor: Gilbert Gamet, Chemin des Nivres, 01190 Pont de Vaux, France

[21] Appl. No.: 487,532

[22] Filed: Mar. 2, 1990

[30] Foreign Application Priority Data

Mar. 7, 1989 [FR] France ..... 89 03204

[51] Int. Cl.[5] ..... H01H 75/02

[52] U.S. Cl. ..... 335/29; 60/528; 60/531

[58] Field of Search ..... 60/528, 531; 335/29, 335/26

[56] References Cited

U.S. PATENT DOCUMENTS 3,213,606 10/1965 Martin et al. .
3,629,744 3/1970 Maier et al. .

FOREIGN PATENT DOCUMENTS 2609574 1/1987 France .

*Primary Examiner*—Leo P. Picard
*Assistant Examiner*—Lincoln Donovan
*Attorney, Agent, or Firm*—Wall and Roehrig

[57] ABSTRACT

Device for the automatic reclosing of breakers, taking the form of an assembly (1) comprising a movable element (3) capable, as a result of a trip of the breaker, of being moved in order to actuate the setting member of the breaker so as to reclose it.

It is defined in that the said movable element (3) is composed of a piston (4) which is mounted inside a stationary housing or enclosure (2) and the movements of which are obtained as a result of the variations in volume of an expandable body contained inside the said enclosure (2), these variations being caused by the heat released by an electrical resistor (8) when it is made live.

11 Claims, 3 Drawing Sheets

DEVICE FOR THE AUTOMATIC RECLOSING OF BREAKERS AND BREAKERS EQUIPPED WITH SUCH A DEVICE

BACKGROUND OF THE INVENTION

The present invention relates to a device making it possible to reclose electrical breakers automatically after they have been tripped as a result of a transient fault.

It is concerned more particularly with a device which can either be mounted independently of the breaker or be integrated in the breaker itself at the design stage of the appliance.

Hitherto, when a domestic or industrial breaker is tripped as a result of a transient fault, the protected circuit is dead until someone recloses it. Consequently, if the trip occurs during a lengthy absence, the installation is deprived of current for this entire period, and this can cause considerable damage, for example losses of frozen foodstuffs, losses of volatile computer data, deactivation of security systems, such as alarms, freeze warnings, etc.

It has therefore been proposed for a very long time to combine with the breakers means making it possible for them to be reclosed automatically. Of the devices provided for carrying out such automatic reclosing, those in most widespread use comprise an electric motor or an electromagnetic coil which is fed by an independent current source and which, by means of a suitable cinematic chain, makes it possible to actuate the setting member of the breaker in order to reclose it. Such devices are relatively heavy and bulky.

Furthermore, when the protected installation has a permanent fault, it is clear that these reclosing devices must not continue to make attempts at reclosing too often or for too long. Consequently, existing devices therefore have delay and actuation-counting systems which complicate the assembly as a whole and increase the cost.

Moreover, breakers are not standardized elements, and they can have highly variable shapes and sizes and also possess different types of actuating systems, such as pushbuttons and rocker levers. The reclosing devices therefore require special adaptation and specific adjustments according to the particular type of breaker.

Besides, it is difficult for the solutions provided hitherto, because of their complexity and cost, to be made suitable for being integrated in the breaker itself at its design stage, whereas it would be advantageous to obtain a self-reclosing appliance.

Now a device for the automatic reclosing of breakers has been found, this being the subject of the present invention, and it overcomes the disadvantages of the prior solutions and is not only of great simplicity in terms of its operating principle, but also of reduced size, and this device can either be combined with existing breakers or integrated in the breaker itself at its design stage.

In the rest of the description, the expression "independent device" will be used to denote the reclosing device according to the invention when it is simply combined with a breaker, whilst the expression "integrated device" will be used to denote a device according to the invention which forms an integral part of the breaker itself.

SUMMARY OF THE INVENTION

In general terms, therefore, the invention relates to a device for the automatic reclosing of breakers, this device taking the form of an assembly comprising a movable element which, as a result of a trip of the breaker, is capable of being moved in order to actuate the setting member of the breaker so as to reclose it, and being defined in that the said movable element (or active member) is composed of a piston which is mounted inside a stationary housing or enclosure and the movements of which are obtained as a result of the variations in volume of a body contained inside the said enclosure, these variations being caused by the heat released by an electrical resistor when it is made live, for example as a result of the trip of the breaker.

The variations in volume of the body which make it possible to actuate the piston are caused by the heat released by the electrical resistor, which makes it possible to expand and/or vaporize a solid, liquid or gas and which will be designated in the rest of the description by the expression "expandable body". The work furnished as a result of the expansion of the expandable body can be utilized, on the one hand, either directly or, if appropriate, by way of a suitable intermediate cinematic chain and, on the other hand, according to three different alternative versions described below.

In a first embodiment according to the invention, the work of the piston is utilized immediately in order to act on the setting member of the breaker so as to reclose it after a trip; in such a case, the electrical resistor is fed by a source independent of the protected circuit.

According to a second embodiment, the work of the piston is utilized beforehand in order to tension a spring which is released only during the reclosing of the breaker in order to actuate its lever and reclose it. In this case, the device is active via its electrical resistor when the breaker is set and therefore affords the possibility of a direct electrical supply; it is likewise subsequently active via its spring when the breaker is to be reclosed.

According to a third embodiment especially advantageous for providing an integrated device, the work of the piston is utilized in order to keep a spring tensioned as long as the device is live and the resistor is therefore being fed.

In this embodiment, if the resistor is not fed, the spring can then relax, at the same time pushing back the piston and jointly actuating the setting lever of the breaker. In this case, the supply to the resistor will advantageously be taken simply downline of the breaker. In this embodiment, the device will make attempts at reclosing over and above instances of breaking, if there are merely current cutoffs, but these attempts are not detrimental.

Each of these three embodiments can be used to obtain both so-called "independent" closing devices and so-called "integrated" devices.

However, the invention and the advantages which it affords will be understood better from the exemplary embodiments which are given below indicatively, but in a non-limiting way, and which are illustrated in the accompanying diagrams in which:

DESCRIPTION OF THE INVENTION

In the rest of the description, for the sake of uniformity the same members (or similar members) will be designated by the same references for the different embodiments exemplified.

Figure 1:
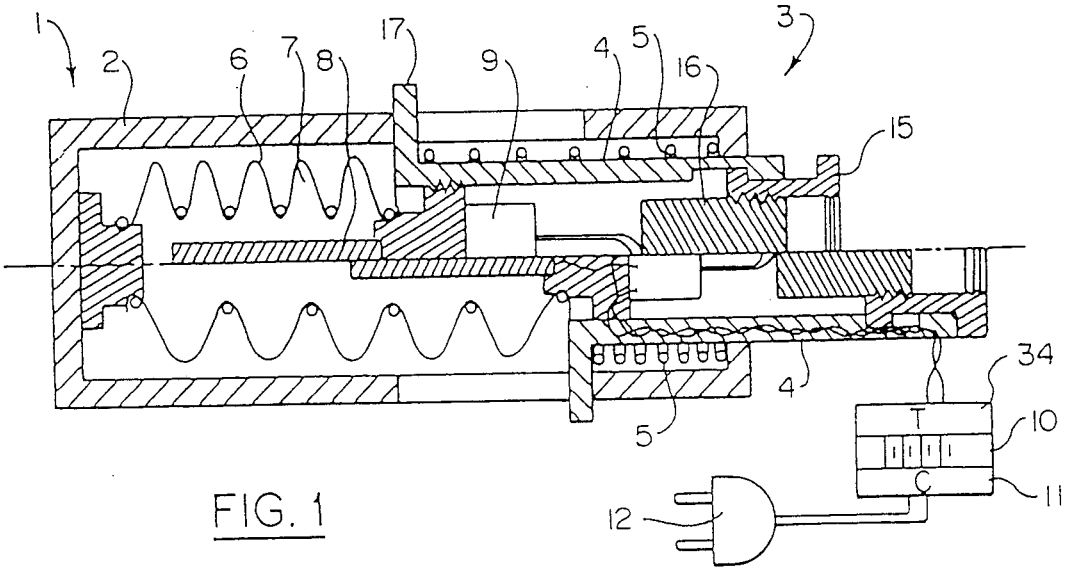
FIG. 1 illustrates a first embodiment of a device according to the invention, showing, in two half-sections, the standby position (upper part of the figure) and the working position (lower part) of an independent device according to the invention.

FIG. 1 illustrates an embodiment of a device according to the invention, this device being of the independent type, that is to say one which can be combined with any type of existing breaker and in which the work furnished by the expandable body is utilized immediately in order to act on the setting member of the breaker. This device, designated by the general reference (1), is composed essentially of a housing (2) supporting a movable element which is designated by the general reference (3) and which, as a result of a trip of the breaker, is capable of being moved in order to actuate the setting member so as to reclose it.

Figure 6A:
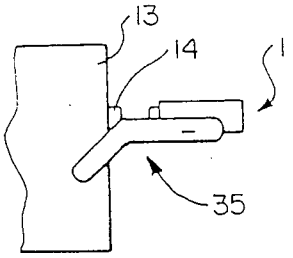
FIGS. 6*a*, 6*b* and 6*c* show how the device according to the invention can be fastened to different types of breakers by means of the supporting member illustrated in FIG. 5.
Figure 6B:
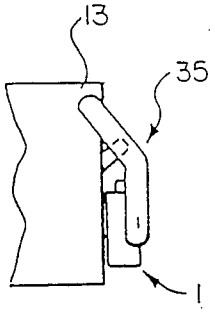

According to the invention, the movable element or active member consists essentially of a piston (4) which is mounted inside the stationary housing (2) and the movements of which are obtained as a result of the variations in volume of a body contained inside the said housing (2). According to this embodiment, the piston (4) is subjected to the action of a restoring spring (5) which tends to keep it in the retracted position. In the present case, the element capable of varying in volume and acting in order to move the said piston (4) consists of a sealed enclosure (6) located at the rear of the piston (4). This sealed enclosure is flexible and deformable and contains a vaporizable liquid (for example, water) (7) which can be heated and brought to boiling by means of a resistor (8). The resistor (8) is fed via a switch (9) by means of accumulators (10) kept charged by a charger (11) connected to the circuit protected by the breaker by way of a connector (12). The device is correctly positioned if, as shown in FIGS. 6*a* and 6*b*, during a trip of the breaker (13) the setting lever (14) of the latter pushes the movable endpiece (15) up against the piston (4) and thereby closes the switch (9) by means of the adjusting screw (16). The resistor (8), being live, then heats the liquid (7) and vaporizes it.

The lower half-section of FIG. 1 shows the movement of the piston arising as a result of the expansion of the vapor in the enclosure (6). This movement, by pushing the setting lever, leads to the reclosing of the breaker. The pushing force, since it depends only on the temperature of the fluid, can easily be controlled and even adjusted if a thermostatic switch (not shown) is connected in series. This force does not depend on the actual stroke of the piston which will therefore automatically adapt to that allowed by the setting lever (14). A delay member (34) is preferably provided and opens the resistor circuit after a given time for a duration sufficient to ensure that the piston (4) resumes its initial position under the effect of the restoring spring (5) and the cooling of the fluid (7), the switch (9) reopening. At the end of the delay, the device will be ready for a new attempt at reclosing, but the accumulators (10) will have discharged a little.

If the closing of the breaker is effective, the charger (11) will restore and maintain the charge of the accumulators. If not, other attempts at reclosing will occur in succession until it is obtained or until the accumulators are exhausted. Thus, if there is a permanent fault in the protected circuit, there will be a limited number of attempts at reclosing, this number being a function of the energy consumption necessary for an actuation and of the capacity of the accumulators. It is possible to make the device inoperative when the protected circuit is to be isolated deliberately. For this purpose, it is sufficient either to push the active member onto its support so that it can no longer react or to equip it with a series switch (not shown) on the resistor circuit. Moreover, part of the piston (4) forms a toe (17) which projects outside the enclosure (2) and which can therefore be actuated manually. Such an embodiment is extremely reliable, because the need for an independent supply makes it possible to carry out several attempts at reclosing before it is exhausted. In contrast, it has the disadvantage of being relatively expensive.

Figure 2:
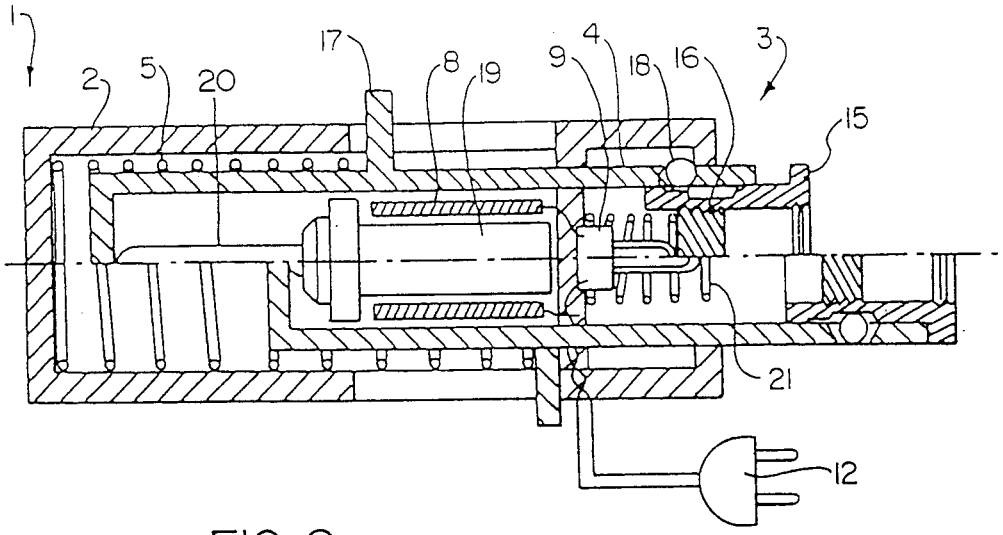
FIG. 2 illustrates another embodiment of a device according to the invention in a similar way to FIG. 1.

FIG. 2 illustrates another embodiment of a device according to the invention which can likewise be fitted to an existing breaker and in which the work furnished by the expandable body is utilized beforehand in order to tension a spring.

In this embodiment, in comparison with the solution described above and illustrated in FIG. 1, the piston (4) compresses a spring (5) which is prevented from relaxing by the presence of a ball (18) blocking the relative movement of an enclosure (2) and of the piston (4). During a trip, the lever of the breaker pushes the movable endpiece (15) of the piston, allowing the ball (18) to descend freely. The spring (5) is released and can push the piston (4) which itself will reclose the breaker.

The lower half-section of this FIG. 2 shows that the extension of the piston closes a bistable switch (9) as a result of the moving away of the adjusting screw (16) connected to the movable endpiece (15). The breaker being reclosed, the annular resistor (8) is made live via the connector (12) and heats a thermostatic element (19), in this particular case of the type with expandable wax, which is arranged inside the piston (4) and which comprises a piston (20) coming to bear against the inner face of the said piston (4). This piston (20) pushes the piston (4) inwards, at the same time tensioning the spring (5). At the end of the stroke, the adjustable screw (16) pushes back the movable endpiece (15) by means of a second spring (21) and acts on the bistable switch (9) so as to open it. The ball (18) is itself pushed outwards. The resistor (8) and the thermostatic element (19) cool; the spring (5) therefore pushes back the piston (4) until it is blocked by the ball (18), with a sufficiently small play to ensure that the bistable switch (9) does not flip when closed. The device is then ready for a new attempt at reclosing.

In the hypothesis where the protected circuit has a permanent fault, the reclosing is followed immediately by a second trip. The resistor (8) remains dead and the device does not make another attempt at reclosing.

Figure 4A:
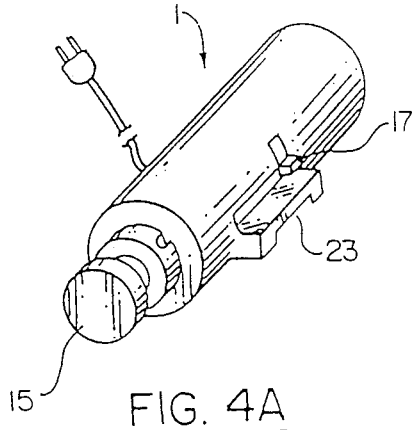
FIGS. 4*a* and 4*b* are diagrammatic perspective views showing the standby position and the working position of the device according to the invention illustrated in FIG. 2.
Figure 4B:
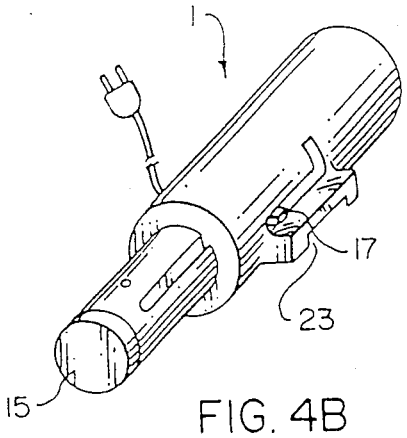

To make this device inoperative when the protected circuit is to be isolated deliberately, it is sufficient either to push the active member onto its support so that it can no longer act or to block the movement of the piston (4) by the rotational positioning of the toe (17) in the blocking zone which can be seen in FIGS. 4*a* and 4*b* and which is provided on the enclosure (2). It is likewise possible to block the movement of the endpiece (15) so that it can no longer release the ball (18). Two successive trips can also be carried out, the second not reclosing automatically. The toe (17) connected to the piston (4) allows the device to be actuated manually.

This second embodiment allows virtually instantaneous reclosing. However, in the practical form shown, since the supply to the resistor is taken from the protected circuit, the system becomes operational again only after the time interval necessary for the retensioning of the spring (5) by the piston (4). If two breaks occur one after the other, the device therefore cannot reclose after the second.

To overcome this disadvantage, it is sufficient to use an independent supply, as for the preceding example. An improvement can also be made by ensuring, by double locking, that the movement of the cylinder (4) is released only if its stroke is free (that is to say, if the piston (20) is in the retracted position and if the endpiece (15) is in the pushed position).

Figure 5:
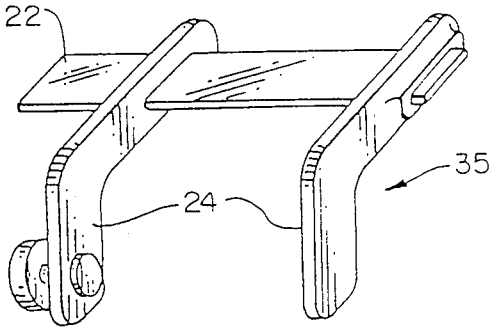
FIG. 5 illustrates in perspective a supporting member making it possible to combine the device according to the invention, as illustrated in FIGS. 4*a* and 4*b*, with a pre-existing breaker.
Figure 7:
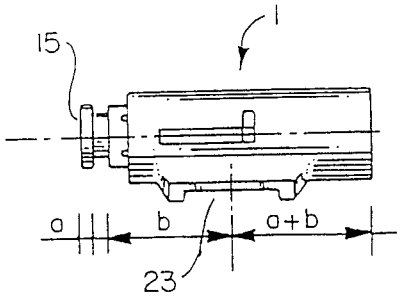
FIG. 7 is a diagrammatic view showing the relation which there must be between particular dimensions of the device illustrated in FIGS. 4*a* and 4*b*, in order to allow it to be installed on the breaker in a simple way and without trial and error or difficult adjustments.
Figure 6C:
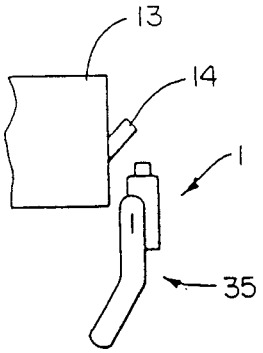

The two above-described embodiments illustrated in FIGS. 1 and 2 can easily be mounted on any type of existing breaker, as shown in FIGS. 6*a* to 6*c*. To carry out such a mounting, it is possible to use a support which is of the type illustrated in FIG. 5 and which, insofar as the dimensions (a and b), as shown in FIG. 7, are adhered to, makes it possible to obtain an installation without the need for difficult adjustments. This supporting member (35) takes the form of an assembly which performs the function of a clamp which is composed essentially of a flat rod (22) intended for supporting the body (1) of the assembly according to the invention. As shown in FIGS. 4*a* and 4*b*, this body (1) can have a base (23) capable of engaging with and being locked on the support plate (22). The assembly (35) also possesses two legs (24), at least one of which can slide at one end and the other of which will have a member (25) allowing the assembly to be clamped on the housing (13) of the breaker. The legs (24) will advantageously have a bent form, so that the member (1) can be positioned both parallel to the front face of the breaker and perpendicularly thereto (see FIGS. 6*a* to 6*c*). The profile of the flat rod (22) and the fastening base (23) of the member (1) will be such that the latter can be snapped on at any location, by being directed forward or rearward and on top or underneath. Moreover, the location of the fastening base (23) will be such that the distance dimension between the axis of this base and the rear bottom is equal to that between the axis of the base and the front of the member which will push the setting lever of the breaker at the moment of activation for the trip (see FIG. 7).

The device can be installed by means of such an assembly accurately and without trial and error by the following procedure:

1) trip the breaker,
2) snap the member (1) on opposite to its normal position,
3) position the support in such a way that the bottom of the member (1) is in contact with the setting lever of the breaker (13),
4) remove the member (1) from the support, reclose the breaker manually and put the member (1) back in place on the support.

The assembly is thus positioned perfectly since, in the event of a trip, the setting lever of the breaker will reach the exact location which will cause the actuation of the device in order to carry out the reclosing.

Figure 3C:
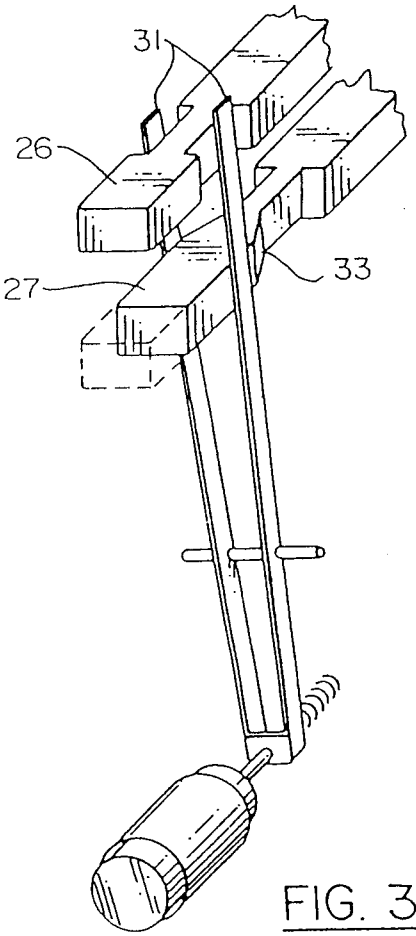
FIGS. 3*a*, 3*b* and 3*c* are diagrammatic views illustrating the structure and functioning of an integrated device according to the invention.
Figure 3B:
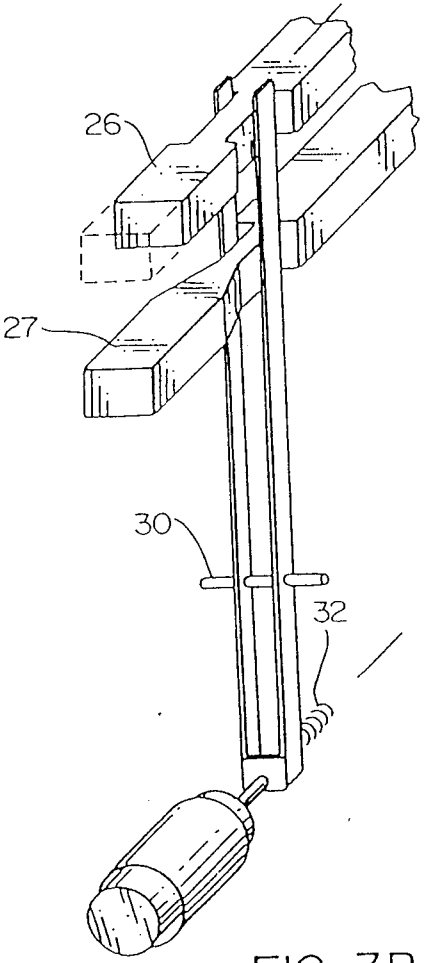
Figure 3A:
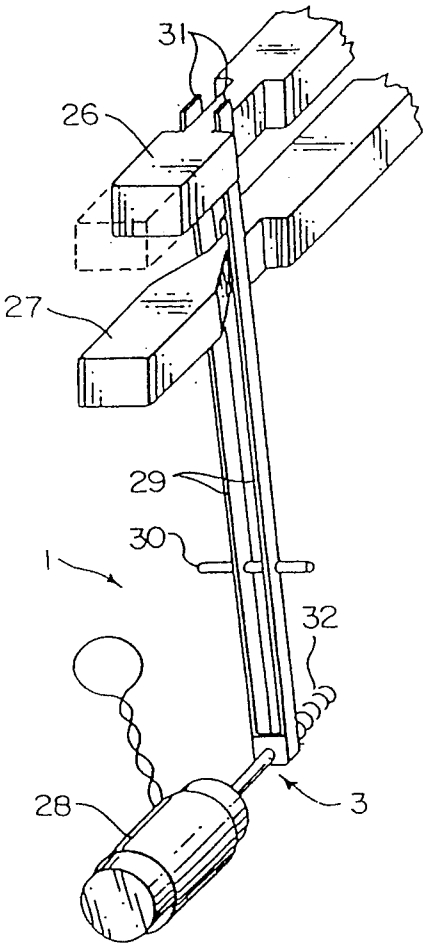

FIGS. 3*a*, 3*b* and 3*c* illustrate how a device according to the invention can be adapted in order to make it possible to provide a self-reclosing breaker, in which the work furnished by the expandable body serves for keeping a spring tensioned as long as the device is live. In these figures, only the main actuating members accessible from outside have been shown. Moreover, this exemplary embodiment is more particularly suitable for a breaker having two pushbuttons, namely a setting button (26) and a trip button (27). In normal use (FIG. 3*a*), the setting button (26) is pushed back and the trip button (27), for its part, is extended. As in the last preceding embodiment, the reclosing device (1) comprises a housing, within which is arranged a pusher or jack actuable by means of an expandable assembly located inside the housing In this particular case, the resistor making it possible to cause the movement of the pusher (3) consists of an annular resistor (28) arranged round the housing. This annular resistor (28) is fed continuously, and the thermostatic or expandable element causing the movements of the pusher (3) acts on rods (29) which are mounted articulated about a rotary axle (30) and the ends (31) of which, for their part, actuate the pusher (26). A spring (32) is compressed when the pusher (3) is in the extended position. During a trip, as shown in FIG. 3*b*, the setting button (26) and the trip button (27) are extended. The resistor (28) is no longer live, and under the action of a spring (32) the rods (29) are gradually pushed back, pivot about their axle (30) and consequently push the setting button (26) back until the breaker is reclosed. The effect of this is to feed the resistor (28) once again and restore the system to its normal configuration. In fact, whenever there is a current cutoff, the reclosing movement will take place, but it will be effective only if there has been a break.

FIG. 3*c* shows the instance when the circuit is to be isolated deliberately. To carry out such an operation, it is sufficient to push back the trip button (27), the effect of this being, because of its cam form (33), to move apart the rods (31) which will therefore no longer be in engagement with the button (26). Reclosing cannot take place automatically and will have to be carried out manually by pressing on the button (26), this then bringing the button (27) out again and restoring the system to its normal configuration.

Such a device can be used whenever the automatic reclosing of a breaker after accidental breaking is to be obtained, without the possibility that this reclosing will occur if the cause of the break is linked to a permanent fault of the protected circuit or if it is deliberate in order to isolate the circuit momentarily.

Such a device of especially simple design makes it possible to provide integrated and compact devices of low cost.

The preceding examples show clearly the advantages afforded by the device according to the invention and the great flexibility of use which it makes possible to achieve.

Of course, the invention is not limited to the examples described above, but it embraces all its alternative versions provided in the same spirit. Thus, according to the embodiments, it may be envisaged to use different types of expandable bodies. Two categories of expandable bodies are especially suitable and correspond to preferred embodiments In fact, it is advantageous to use a body of which the expansion is not linear as a function of the temperature, but on the contrary sudden within a temperature range of between approximately 40° C., thus making it possible to be outside the customary ambient temperatures, and 250° C. for reasons of safety. Such a characteristic is obtained by using an expandable body consisting of a vaporizable liquid with a high increase in its vapor tension within this temperature range, such as, for example, water, or a solid expandable body which liquefies with high expansion, such as, for example, the waxes used in thermostatic elements Of course, the choice of the resistor and the dimensions of the piston are determined according to the characteristics of the expandable body.

I claim:

1. Apparatus for automatically reclosing an electrical circuit breaker that includes a housing containing a movable means capable of moving into contact with a breaker to reclose said breaker in the event of a breaker trip, said movable means including a piston mounted within said housing that is slidable therein between a first and a second position, and a heat expandable means mounted inside said housing in contact with said piston, heating means operable in the event of a trip to heat said expandable means whereby the expandable means forces the piston from said first position to said second position into reclosing contact with the breakers, restoring means operable after a given period of time to move said piston from said second position to said first position, and means to reactuate said heating means when said restoring means has moved said piston from said second position to said first position in the event the breaker has re-tripped.

2. The apparatus of claim 1 wherein the expandable member includes a material selected from a group consisting of solids, liquids, and gases.

3. The apparatus of claim 1 wherein said expandable member expands non linearly in respect to the amount of heat applied thereto.

4. The apparatus of claim 3 wherein the heating means is a resistor and the expandable means contains a liquid that is vaporized when the resistor is rendered operable, the saturated vapor tension of said liquid increasing within a temperature range of between 40° and 250° C.

5. The apparatus of claim 3 wherein the heating means is a resistor and the expandable means contains a meltable solid that liquifies and increase its volume within a temperature range of between 40° and 250° C.

6. The apparatus of claim 1 that further includes an adjustable support means for said housing for selectively positioning the housing in regard to said breaker.

7. The apparatus of claim 1 that further includes rod means for connecting the piston to the circuit breaker.

8. Apparatus for automatically reclosing an electrical breaker that includes a housing containing a piston slidable therein between a first position and a second position, capable of moving into reclosing contact with a breaker in the event of a trip, a biasing means for urging the piston into reclosing contact with said breaker, a heat expandable means in contact with said piston, which when heated expands to prevent the biasing means from urging the piston into reclosing contact with said breaker, heating means for heating the expandable means that is rendered inoperable when a trip occurs, so that the piston will move from said first position to said second position, and restoring means operable after a given period of time to move said piston from said second position to said first position and re-enable said heating means, means to disable said heating means when said restoring means has moved said piston from said second position to said first position in the event the breaker has re-tripped.

9. Apparatus of claim 8 wherein the biasing means is a spring that is held tensioned by the piston and is released by the expandable means in the event the heating means in rendered inoperable when a trip occurs.

10. The apparatus of claim 8 that further includes an adjustable support means for said housing for selectively positioning the housing in regard to said breaker.

11. The apparatus of claim 8 that further includes rod means for connecting the piston to the circuit breaker.

* * * * *